US010221543B2

(12) United States Patent
Motomura

(10) Patent No.: US 10,221,543 B2
(45) Date of Patent: Mar. 5, 2019

(54) ATTACHMENT PIN ASSEMBLY

(71) Applicant: SEIKI KOEI CORPORATION, Higashiosaka-shi, Osaka (JP)

(72) Inventor: Yasunori Motomura, Higashiosaka (JP)

(73) Assignee: SEIKI KOEI CORPORATION, Higashiosaka-Shi, Osaka (JP)

( * ) Notice: Subject to any disclaimer, the term of this patent is extended or adjusted under 35 U.S.C. 154(b) by 0 days.

(21) Appl. No.: 15/738,253

(22) PCT Filed: Dec. 19, 2016

(86) PCT No.: PCT/JP2016/087734
§ 371 (c)(1),
(2) Date: Dec. 20, 2017

(87) PCT Pub. No.: WO2017/110722
PCT Pub. Date: Jun. 29, 2017

(65) Prior Publication Data

US 2018/0163377 A1 Jun. 14, 2018

(30) Foreign Application Priority Data

Dec. 21, 2015 (JP) ..... 2015-249103

(51) Int. Cl.
*E02F 9/28* (2006.01)
*E02F 3/40* (2006.01)
(Continued)

(52) U.S. Cl.
CPC ..... *E02F 9/28* (2013.01); *E02F 3/40* (2013.01); *E02F 3/60* (2013.01); *E02F 3/80* (2013.01)

(58) Field of Classification Search
CPC ..... E02F 9/2816; E02F 9/2891; E02F 9/2841; E02F 9/2825; E02F 9/2833; E02F 9/2858;
(Continued)

(56) References Cited

U.S. PATENT DOCUMENTS 1,808,311 A * 6/1931 Madonna ..... E02F 9/2825 37/456
7,313,877 B2 * 1/2008 Clendenning ..... E02F 9/2833 37/456
(Continued)

FOREIGN PATENT DOCUMENTS

JP 1993-009437 2/1993
JP 2014-118760 6/2014
WO WO 2011/125794 10/2011

OTHER PUBLICATIONS

International Search Report for PCT/JP2016/087734, dated Mar. 14, 2017, 4 pages.

*Primary Examiner* — Robert E Pezzuto
(74) *Attorney, Agent, or Firm* — Nixon & Vanderhye P.C.

(57) ABSTRACT

An attachment pin assembly includes a pin body to be inserted into first through-holes of a drilling tool and a second through-hole of an adaptor, the first and second through-holes being arranged eccentrically with respect to each other; a bush portion provided on one end side of the pin body; a detachment prevention member of the bush portion screwed to one end of the pin body; and a stopper portion provided on the other end side of the pin body and configured such that a side surface portion arranged on the outside of the pin body in a radial direction thereof in the first through-hole is locked on an inner wall surface of the tooth forming the first through-hole to stop rotation of the pin body.

1 Claim, 12 Drawing Sheets

(51) Int. Cl.
*E02F 3/60* (2006.01)
*E02F 3/80* (2006.01)

(58) Field of Classification Search
CPC ... E02F 9/2875; E02F 3/40; E02F 3/58; E02F 9/28; E02F 3/60; E02F 3/80
USPC ..... 37/446, 452–460; 172/699, 701.1–701.3
See application file for complete search history.

(56) References Cited

U.S. PATENT DOCUMENTS

| | | | | |
|---|---|---|---|---|
| 7,603,799 | B2 * | 10/2009 | Campomanes ..... | E02F 9/2841 37/456 |
| 9,267,270 | B2 * | 2/2016 | Tanaka ..... | E02F 9/2825 |
| 2009/0165339 | A1 * | 7/2009 | Watanabe ..... | E02F 9/2816 37/454 |
| 2011/0119964 | A1 * | 5/2011 | Karlsson ..... | E02F 9/2833 37/444 |
| 2012/0222336 | A1 | 9/2012 | Itou et al. | |
| 2014/0250743 | A1 | 9/2014 | Tanaka et al. | |
| 2017/0089045 | A1 * | 3/2017 | Dare ..... | E02F 3/40 |

* cited by examiner

ATTACHMENT PIN ASSEMBLY

This application is the U.S. national phase of International Application No. PCT/JP2016/087734 filed Dec. 19, 2016 which designated the U.S. and claims priority to JP Patent Application No. 2015-249103 filed Dec. 21, 2015, the entire contents of each of which are hereby incorporated by reference.

TECHNICAL FIELD

The present invention relates to an attachment pin assembly for attaching a drilling tool to an adaptor of an operating machine.

BACKGROUND ART

An operating machine such as a power shovel includes an operating portion such as a bucket. Various drilling tools are attached to the operating portion. For example, a plurality of adaptors is, at predetermined intervals, fixed to a tip end portion of the bucket of the power shovel for drilling. Moreover, teeth as the drilling tools are each attached to the adaptors. The teeth are abraded or damaged in a drilling process, and therefore, are replaced as necessary.

Patent Literature 1 discloses such an attachment pin assembly for attaching the tooth to the adaptor of the bucket.

That is, a pair of first through-holes is formed at the tooth, and a second through-hole is formed at the adaptor. In an attachment state in which the adaptor is inserted into the tooth in contact with the tooth, the first and second through-holes are arranged to penetrate the tooth and the adaptor. In the tooth attachment state in which the adaptor contacts the inside of the tooth, the first and second through-holes are in such a concentric state that the centers thereof are coincident with each other.

The attachment pin assembly includes a circular columnar pin body inserted into the first and second through-holes, a cylindrical bush arranged at an end portion of the pin body in each first through-hole, and a bolt and a washer provided at each end of the pin body to prevent detachment of the bush from the each end of the pin body. Moreover, the bush is movable in an axial direction of the pin body between the adaptor and the washer on an outer peripheral surface of the pin body.

CITATION LIST

Patent Literature

PATENT LITERATURE 1: International Patent Application Publication No. 2011/125794

SUMMARY OF THE INVENTION

Problems to be Solved by the Invention

However, in Patent Literature 1 as described above, when the bolt is screwed to one end side of the pin body and the screwed bolt is loosened, the other end side of the pin body needs to be fixed with a jig etc. to prevent rotation of the pin body. This leads to a problem that the process of assembling and detaching the attachment pin assembly is complicated.

Further, in, e.g., a case where an interval between adjacent ones of the teeth is narrow or a case where teeth are arranged next to a certain tooth with the teeth being shifted back and forth as in FIG. 8 of Patent Literature 1 as described above, a space for the process of attaching the pin assembly is narrow. For this reason, the above-described typical attachment pin assembly has a problem that it is difficult to perform the process of assembling and detaching the attachment pin assembly.

The present invention has been made in view of the above-described points, and a main object of the present invention is to facilitate the process of assembling and detaching an attachment pin assembly.

Solution to the Problems

An attachment pin assembly of the present invention is an attachment pin assembly for attaching and fixing a drilling tool to an adaptor of an operating machine in an attachment state of the drilling tool in which the adaptor is inserted into the drilling tool in contact with the drilling tool. The drilling tool is provided with a pair of first through-holes, and the adaptor is provided with a second through-hole, the second through-hole having a smaller inner diameter than that of each first through-hole. The pair of first through-holes and the second through-hole are arranged to penetrate the drilling tool and the adaptor in the attachment state of the drilling tool, and are arranged such that the center axes thereof are eccentric with respect to each other. The attachment pin assembly includes a pin body to be inserted into the first through-holes and the second through-hole, a bush portion provided on one end side of the pin body and arranged on the outside of the pin body in a radial direction thereof in the first through-hole, a detachment prevention member screwed to one end of the pin body to prevent detachment of the bush portion from one end side of the pin body, and a stopper portion provided on the other end side of the pin body and configured such that a side surface portion arranged on the outside of the pin body in the radial direction thereof in the first through-hole is locked on an inner wall surface of the drilling tool forming the first through-hole to stop rotation of the pin body.

Moreover, a groove portion extending along a direction perpendicular to the center of the pin body may be formed at a side surface portion of the pin body on the other end side thereof. The stopper portion may be arranged in the groove portion, and the side surface portion of the stopper portion may be formed in an arc shape. The stopper portion may be sandwiched between the groove portion of the pin body and the inner wall surface of the drilling tool forming the first through-hole, thereby stopping rotation of the pin body.

Effects of the Invention

According to the present invention, the process of assembling and detaching the attachment pin assembly can be facilitated.

DESCRIPTION OF THE EMBODIMENTS

Embodiments of the present invention will be described below in detail with reference to the drawings. Note that the present invention is not limited to the embodiments below.

First Embodiment

Figure 1:
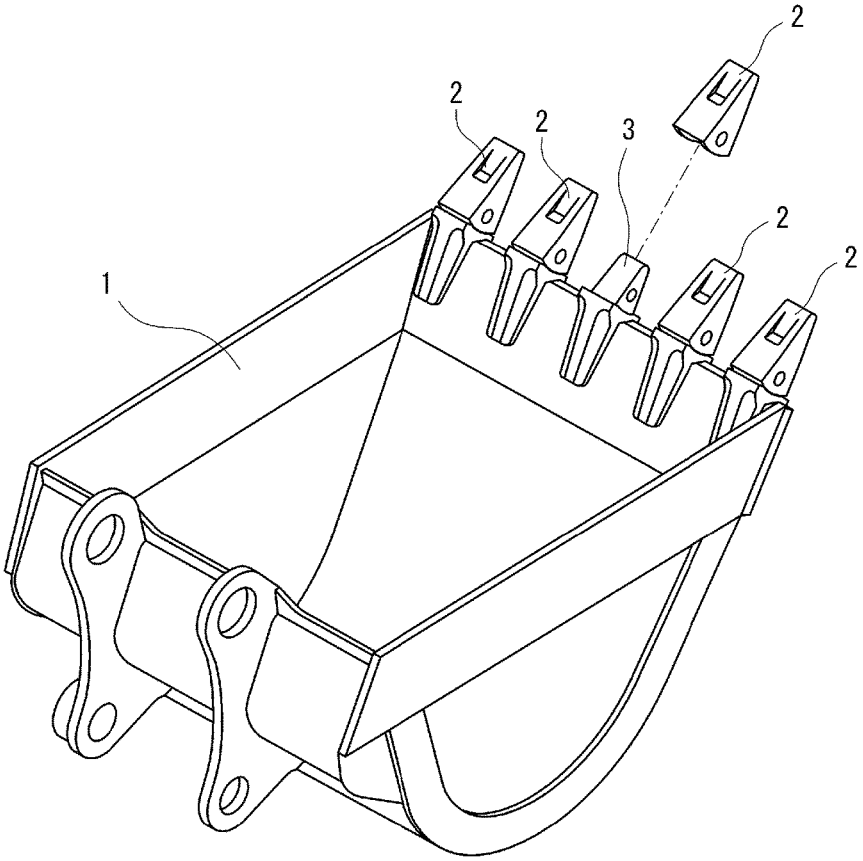
FIG. 1 is a perspective view of a tooth attachment structure of a bucket in the present embodiment.

FIG. 1 illustrates a tooth attachment structure of a bucket 1 of the present embodiment.

Although not shown in the figure, the bucket (an operating portion) 1 is mounted on an arm of a power shovel (an operating machine). As illustrated in FIG. 1, a plurality of adaptors 3 is fixed to a tip end portion of the bucket 1 for drilling. Teeth 2 as drilling tools are each attached to the adaptors 3. The teeth 2 are abraded or damaged in a drilling process, and therefore, are replaced as necessary.

Figure 2:
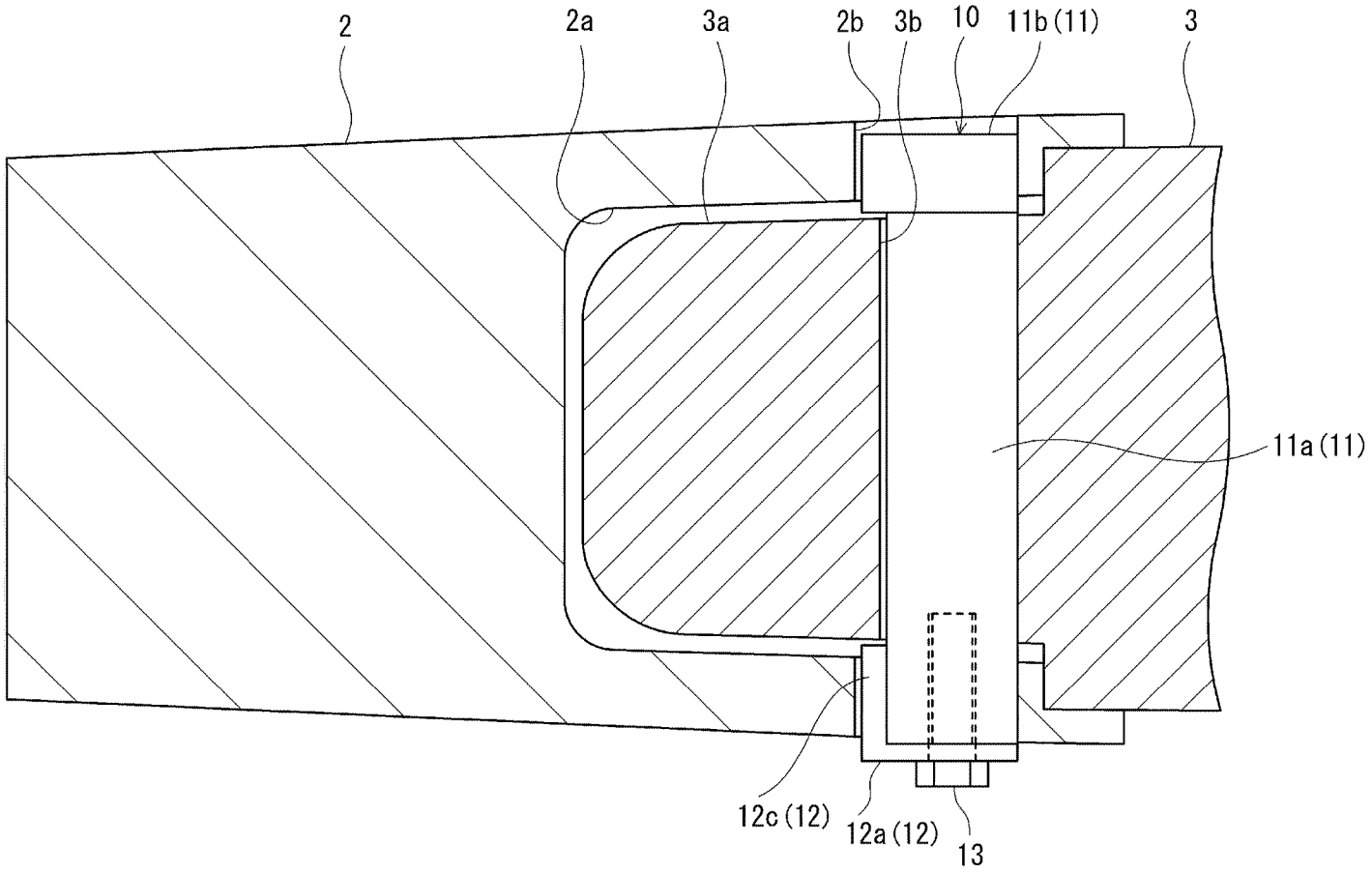
FIG. 2 is a sectional view of the tooth attachment structure in the first embodiment.
Figure 3:
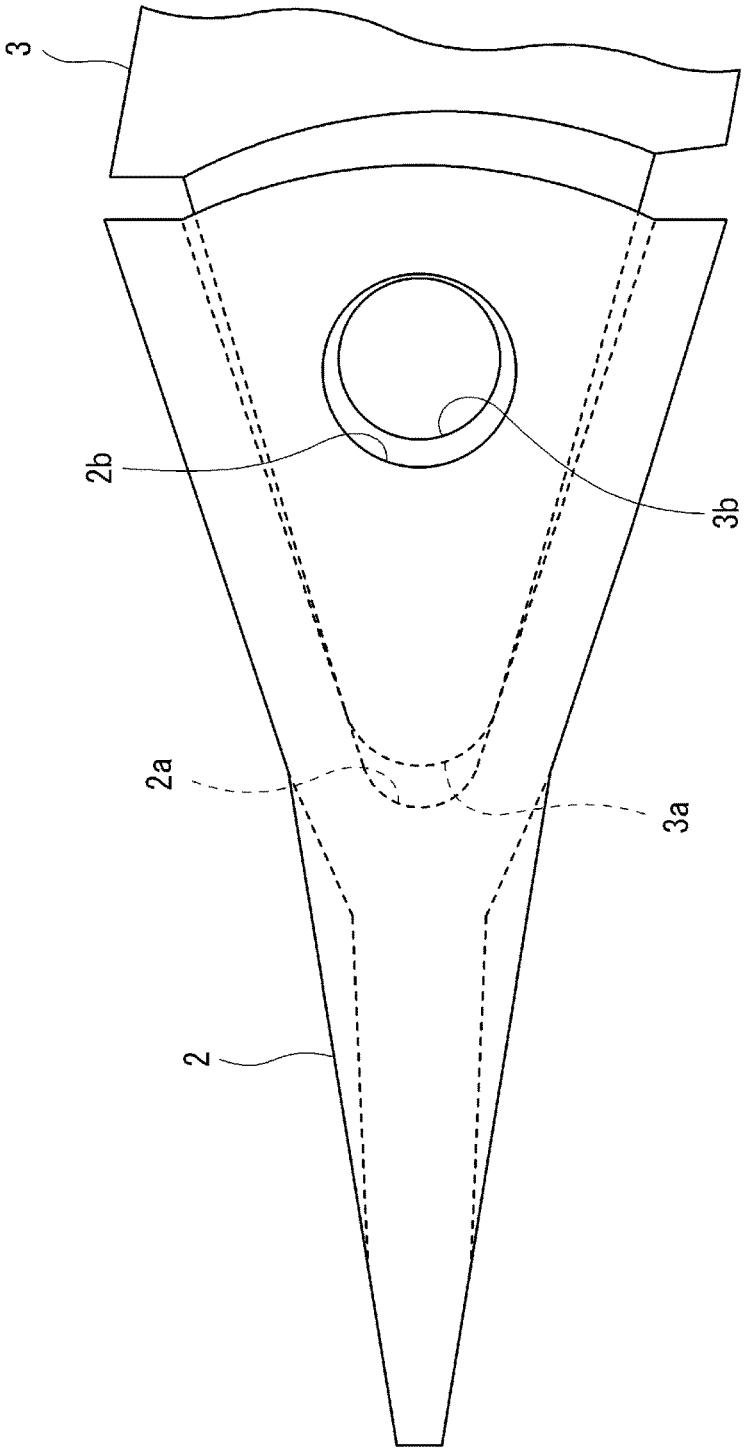
FIG. 3 is a side view of a state of attachment of a tooth to an adaptor in the first embodiment.
Figure 4:
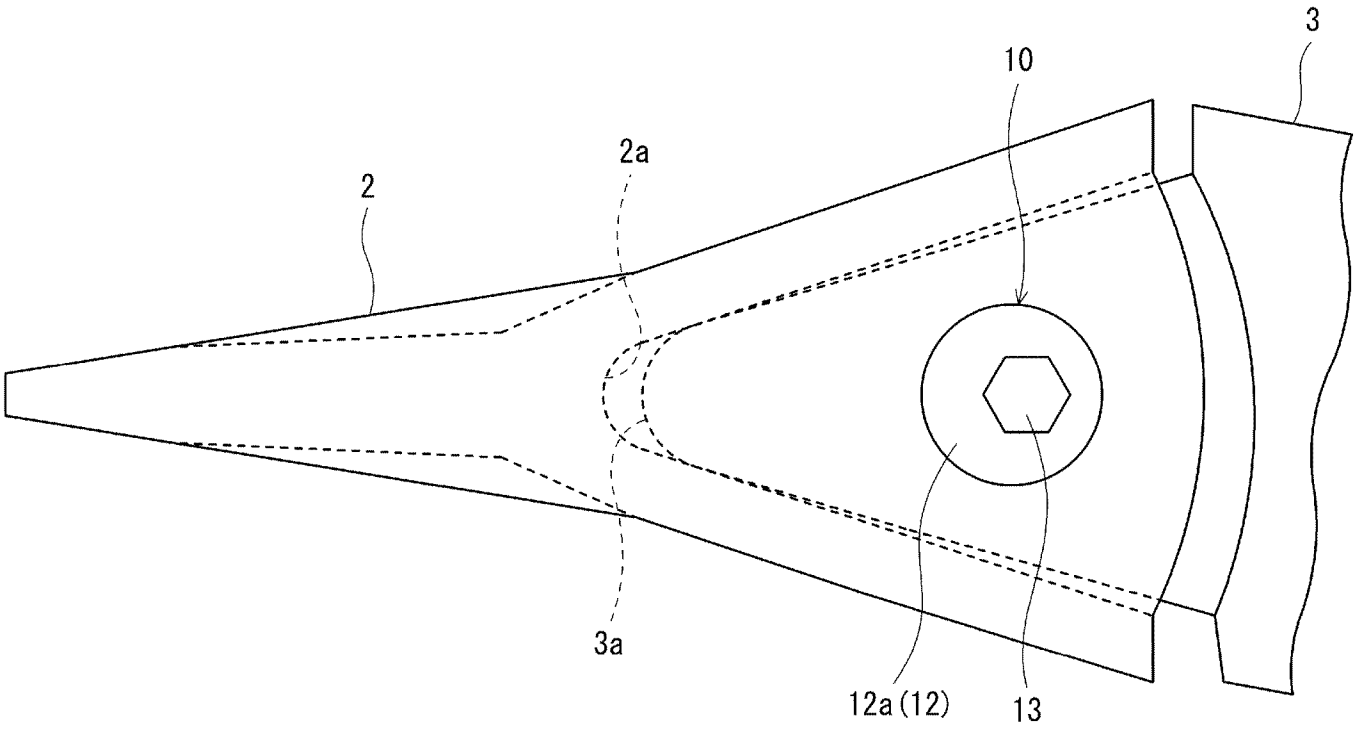
FIG. 4 is a side view of the tooth attached to an attachment pin assembly in the first embodiment.

FIGS. 2 to 4 illustrate a state of attachment of the tooth 2 to the adaptor 3. The tooth attachment structure in the present embodiment is, as illustrated in FIG. 2, a structure for attaching the tooth 2 to the bucket 1. The tooth attachment structure includes the tooth 2, the adaptor 3, and an attachment pin assembly 10.

The tooth 2 is a claw-shaped member attached to the drilling tip end portion of the bucket 1 for performing drilling with the bucket 1, and as illustrated in FIGS. 3 and 4, has a wedge shape narrowed toward a tip end thereof. As illustrated in FIG. 2, the tooth 2 has a recessed portion 2*a* and a pair of first through-holes 2*b*.

The recessed portion 2*a* is, in the tooth 2, formed from a back end opening toward the tip end of the tooth 2. An insertion portion 3*a* of the adaptor 3 as described later is inserted into the recessed portion 2*a*. As in the outer shape of the tooth 2, the recessed portion 2*a* has a wedge shape whose inner width is narrowed toward a tip end thereof.

Each first through-hole 2*b* penetrates the tooth 2 from a side surface thereof to the recessed portion 2*a*, and the first through-holes 2*b* are each formed at right and left side wall portions of the tooth 2. The first through-holes 2*b* are formed along a direction perpendicular to a longitudinal direction of the tooth 2 (a direction connecting between a back end and the tip end of the tooth 2). The later-described attachment pin assembly 10 is inserted into the first through-holes 2*b*.

As illustrated in FIG. 1, the plurality of adaptors 3 is provided at predetermined intervals at the tip end portion of the bucket 1, and is fixed to the tip end portion of the bucket 1 by welding etc. The above-described teeth 2 are each attached to the adaptors 3. As illustrated in FIG. 2, the adaptor 3 has the insertion portion 3*a* and a second through-hole 3*b*.

The insertion portion 3*a* is formed at a tip end of the adaptor 3, and is formed in a wedge shape in accordance with the recessed shape of the recessed portion 2*a* formed in the tooth 2. As illustrated in FIG. 3, the insertion portion 3*a* is inserted into the recessed portion 2*a* in the tooth 2, and an outer wall surface of the insertion portion 3*a* contacts an inner wall surface of the recessed portion 2*a*. In this manner, an attachment state of the tooth 2 is brought.

The second through-hole 3*b* penetrates the insertion portion 3*a* of the adaptor 3 in a width direction thereof (a right-to-left direction in FIG. 2). As in the above-described first through-holes 2*b*, the later-described attachment pin assembly 10 is inserted into the second through-hole 3*b*. The second through-hole 3*b* has a slightly-larger inner diameter than the outer diameter of a pin body 11 of the attachment pin assembly 10 as described later. On the other hand, the inner diameter of the second through-hole 3*b* is smaller than that of the first through-hole 2*b*.

As illustrated in FIG. 3, the pair of first through-holes 2*b* and the second through-hole 3*b* as described above are arranged to penetrate the tooth 2 and the adaptor 3 in the attachment state of the tooth 2, and are arranged such that the center axes of the first through-holes 2*b* and the second through-hole 3*b* are eccentric with respect to each other.

Particularly in the attachment state of the tooth 2 in which the insertion portion 3*a* of the adaptor 3 contacts the recessed portion 2*a* of the tooth 2, inner wall surfaces of the tooth 2 forming the first through-holes 2*b* and an inner wall surface of the adaptor 3 forming the second through-hole 3*b* are substantially lined up on a back end side of the tooth 2 as viewed laterally (as viewed in a direction perpendicular to the plane of paper of FIG. 3). This reduces rattling of the tooth 2 on the adaptor 3.

FIGS. 5 to 9 illustrate the attachment pin assembly 10 in a first embodiment. The attachment pin assembly 10 is a member for attaching the tooth 2 to the adaptor 3, and is for preventing the tooth 2 from dropping out of the adaptor 3. As illustrated in FIG. 2, the attachment pin assembly 10 is, in the attachment state of the tooth 2, inserted into the first through-holes 2*b* of the tooth 2 and the second through-hole 3*b* of the adaptor 3.

Figure 5:
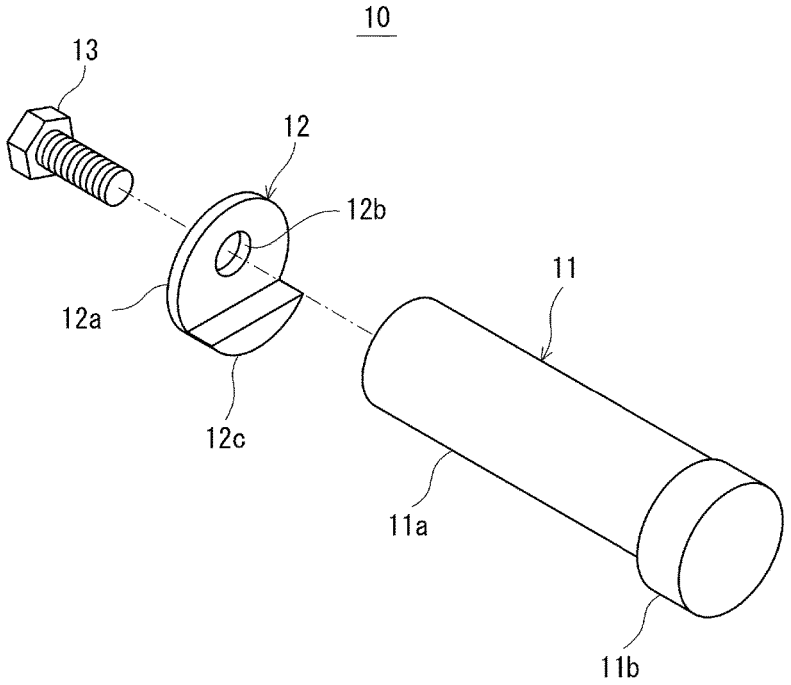
FIG. 5 is an exploded perspective view of a structure of the attachment pin assembly in the first embodiment.
Figure 6:
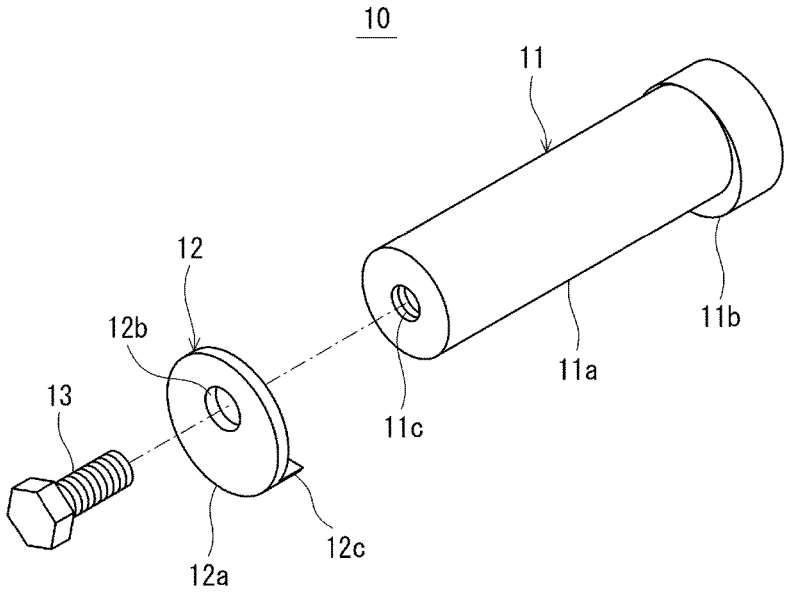
FIG. 6 is an exploded perspective view of the structure of the attachment pin assembly in the first embodiment.

As illustrated in FIGS. 2, 5, and 6, the attachment pin assembly 10 includes the pin body 11, a bush portion 12*c*, detachment prevention members 12, 13 of the bush portion 12*c*, and a stopper portion 11*b*.

Figure 7:
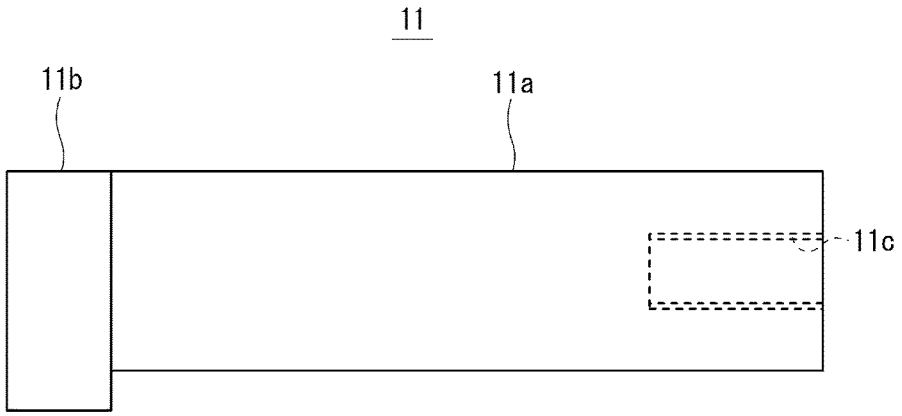
FIG. 7 is a front view of a pin body in the first embodiment.
Figure 8:
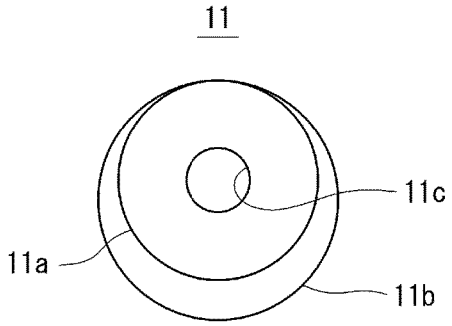
FIG. 8 is a right side view of the pin body in the first embodiment.

As illustrated in FIGS. 5 to 7, the pin body 11 has a circular columnar shaft portion 11*a* as a metal pin. The pin body 11 is configured to be inserted into the first through-holes 2*b* and the second through-hole 3*b*. A screw hole 11*c* is formed on one end side of the shaft portion 11*a*. The screw hole 11*c* is formed in the vicinity of the center of the shaft portion 11*a*. In a state in which the shaft portion 11*a* is inserted into the second through-hole 3*b* of the adaptor 3, the center of the shaft portion 11*a* is arranged at the substantially same position as that of the center of the second through-hole 3*b*.

The bush portion 12*c* is provided on one end side of the pin body 11. In a state in which the pin body 11 is inserted into the second through-hole 3*b*, the bush portion 12*c* is arranged in the first through-hole 2*b*, and is arranged on the outside of the pin body 11 in a radial direction thereof. Moreover, the bush portion 12*c* is formed integrally with a later-described washer member 12.

The detachment prevention members 12, 13 are members screwed onto one end of the pin body 11 to prevent detachment of the bush portion 12*c* from one end side of the pin body 11. The detachment prevention members 12, 13 in the first embodiment include the washer member 12 and a bolt 13.

Figure 9:
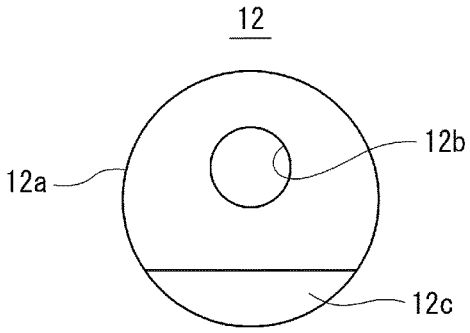
FIG. 9 is a side view of a washer member in the first embodiment.

As illustrated in FIGS. 5, 6, and 9, the washer member 12 has a circular plate-shaped washer body 12*a*, a through-hole 12*b*, and the bush portion 12*c*. The through-hole 12*b* is formed at a position shifted from the center axis of the washer body 12*a*, and penetrates the washer body 12*a* in a thickness direction thereof. Note that the through-hole 12*b* may be formed on the center axis of the washer body 12*a*.

The bush portion 12*c* is arranged at the side of the washer body 12*a*, and is formed integrally with the washer body 12*a* to protrude from a flat surface portion of the washer body 12*a*. The bush portion 12*c* has an arc-shaped side surface. The side surface of the bush portion 12*c* is formed continuously to and integrally with an arc-shaped side surface of the washer body 12*a*. In a state in which the bolt 13 is inserted into the through-hole 12*b* of the washer member 12, the bolt 13 is screwed into the screw hole 11*c* formed at the shaft portion 11*a* of the pin body 11. In this manner, the bush portion 12*c* is fixed to the pin body 11. Moreover, as illustrated in FIG. 2, the bush portion 12*c* contacts a side surface of the adaptor 3 in the attachment state of the tooth 2, thereby serving as a retainer for the attachment pin assembly 10.

As illustrated in FIG. 2, the stopper portion 11*b* is provided on the other end side of the pin body 11. Moreover, as illustrated in FIGS. 2 and 5 to 8, the stopper portion 11*b* is formed in a circular plate shape with a larger outer diameter than the inner diameter of the second through-hole 3*b*, and is formed integrally with the pin body 11 in a state in which the stopper portion 11*b* is eccentric with respect to the center of the pin body 11. The stopper portion 11*b* in the first embodiment has the substantially same outer diameter as the inner diameter of the first through-hole 2*b*.

Thus, the stopper portion 11*b* has a side surface portion arranged on the outside of the pin body 11 in the radial direction thereof in the first through-hole 2*b*. The side surface portion of the stopper portion 11*b* is formed in an arc shape. This side surface portion of the stopper portion 11*b* is locked on the inner wall surface of the tooth 2 forming the first through-hole 2*b*, and therefore, rotation of the pin body 11 is stopped.

In the case of attaching the tooth 2 to the adaptor 3 of the operating machine, the pin body 11 is inserted into the first through-holes 2*b* and the second through-hole 3*b* with the tooth 2 being attached to the adaptor 3. In this state, the stopper portion 11*b* is arranged in the first through-hole 2*b*. Meanwhile, the washer member 12 and the bush portion 12*c* are together arranged on one end side of the pin body 11. Then, the washer member 12 and the bolt 13 are screwed to one end of the pin body 11. In this manner, the attachment pin assembly 10 is attached to the tooth 2 and the adaptor 3, and the bush portion 12*c* is not detached from one end side of the pin body 11.

In such screwing, the pin body 11 tends to rotate about the center axis of the second through-hole 3*b*. However, since the center of the pin body 11 and the center of the stopper portion 11*b* are eccentric with respect to each other, the side surface portion of the stopper portion 11*b* is locked on the inner wall surface of the tooth 2 forming the first through-hole 2*b*. Thus, rotation of the pin body 11 can be stopped upon screwing.

As described above, according to the first embodiment, it is configured such that the center of the pin body 11 and the center of the stopper portion 11*b* are eccentric with respect to each other and the side surface of the stopper portion 11*b* is locked on the inner wall surface of the first through-hole 2*b* of the tooth 2. Thus, first through-holes 2*b* of a general-purpose tooth 2 are utilized so that the process of assembling and detaching an attachment pin assembly 10 can be performed. Thus, the attachment pin assembly 10 of the first embodiment has an advantage that it is not necessary to prepare a special tooth provided with through-holes in a variant shape different from a normal circular shape.

Moreover, in the first embodiment, when the washer member 12 and the bolt 13 are screwed to one end of the pin body 11, it is not necessary to fix the other end side of the pin body 11 by means of another jig. Thus, the process of assembling the attachment pin assembly 10 can be facilitated.

On the other hand, in the case of detaching the tooth 2 from the adaptor 3, when the screwed bolt 13 is loosened, the pin body 11 tends to rotate about the center axis of the second through-hole 3*b*. However, the side surface portion of the stopper portion 11*b* is locked on the inner wall surface of the tooth 2 forming the first through-hole 2*b*, and therefore, rotation of the pin body 11 can be stopped. Thus, according to the first embodiment, when the screwed bolt 13 is loosened, it is not necessary to fix the other end side of the pin body 11 by means of another jig, and therefore, the process of detaching the attachment pin assembly 10 can be facilitated.

Further, since the stopper portion 11*b* is formed integrally with the pin body 11, the number of components of the attachment pin assembly 10 can be reduced. Thus, the process of assembling and detaching the attachment pin assembly 10 can be further facilitated.

In addition, since the stopper portion 11*b* has the substantially same outer diameter as the inner diameter of the first through-hole 2*b*, the first through-hole 2*b* on the other end side of the pin body 11 can be closed with the stopper portion 11*b*. This suppresses a foreign material such as dirt from entering the first through-hole 2*b*, leading to improvement of abrasion resistance of the stopper portion 11*b*.

Second Embodiment

Figure 10:
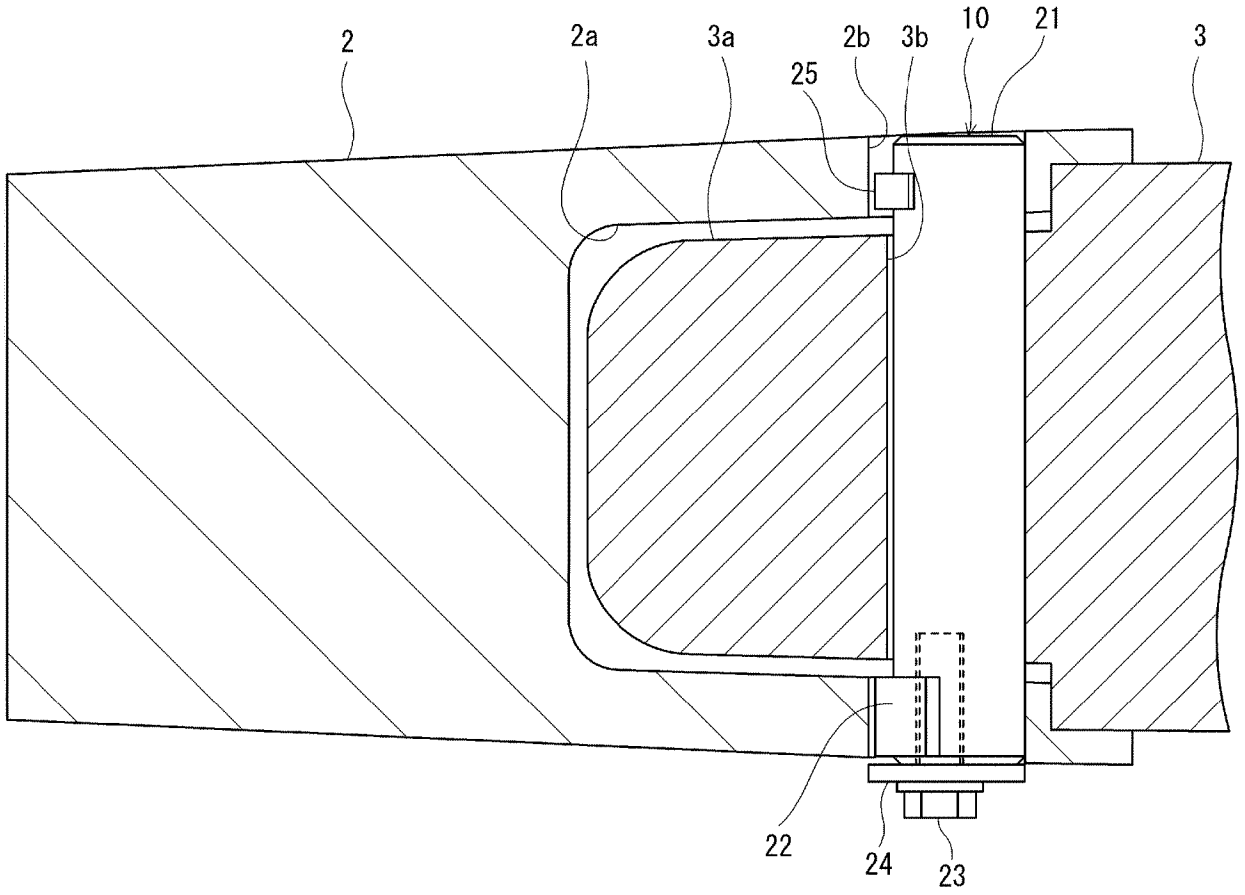
FIG. 10 is a sectional view of a tooth attachment structure in a second embodiment.

FIGS. 10 to 16 illustrate a second embodiment. FIG. 10 illustrates an attachment state of a tooth 2 to an adaptor 3. FIGS. 11 to 16 illustrate an attachment pin assembly 10 in the second embodiment.

Figure 11:
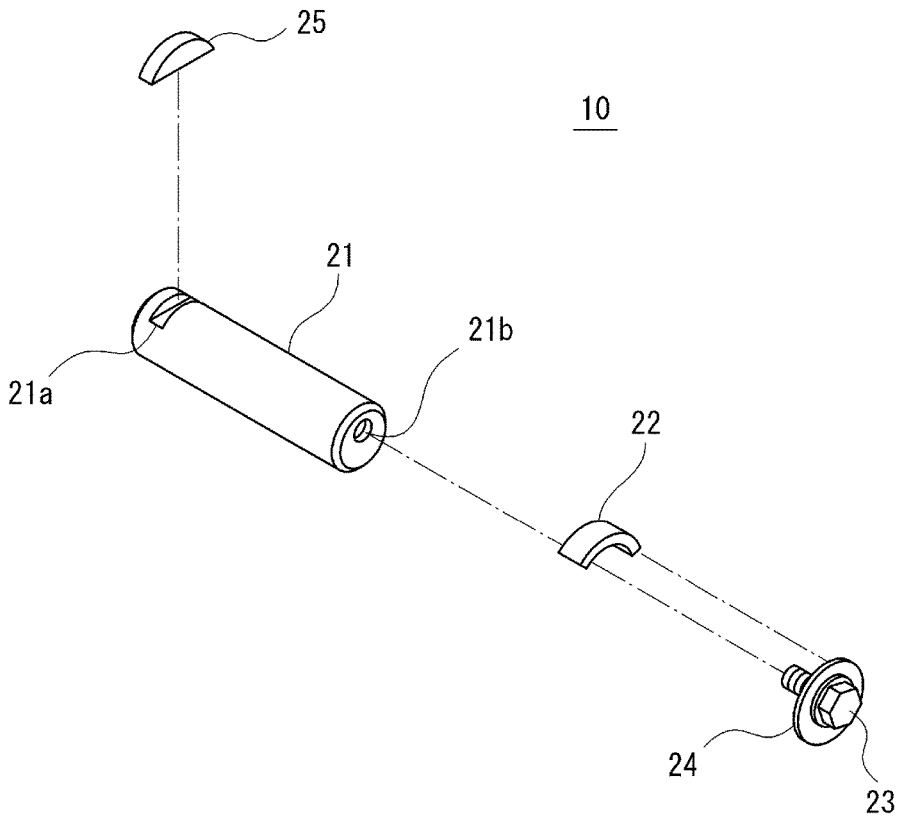
FIG. 11 is an exploded perspective view of a structure of an attachment pin assembly in the second embodiment.
Figure 12:
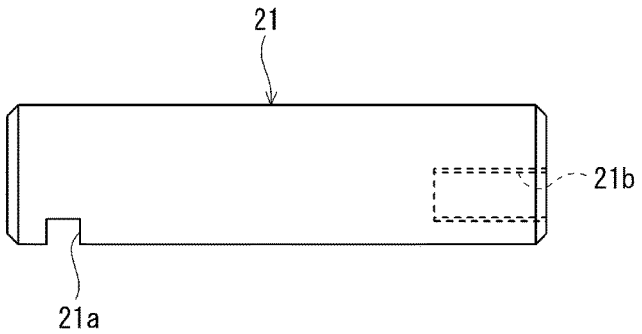
FIG. 12 is a front view of a pin body in the second embodiment.
Figure 13:
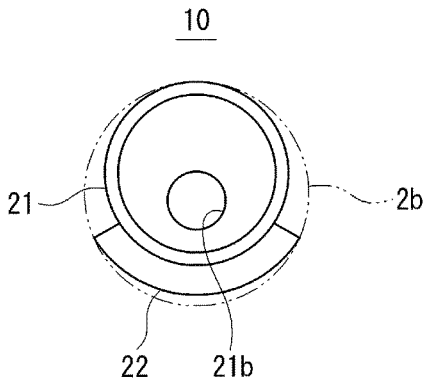
FIG. 13 is a right side view of a positional relationship between the pin body and a bush portion in the second embodiment.

As illustrated in FIGS. 10 to 12, the attachment pin assembly 10 in the second embodiment includes a pin body 21, a bush portion 22, detachment prevention members 23, 24 of the bush portion 22, and a stopper portion 25.

The pin body 21 is a metal pin formed in a circular columnar shape. The pin body 21 is inserted into first through-holes 2*b* of the tooth 2 and a second through-hole 3*b* of the adaptor 3. A screw hole 21*b* is formed on one end side of the pin body 21. The screw hole 21*b* is formed at a position shifted from the center of the pin body 21, and as illustrated in FIG. 10, is arranged at the substantially same position as that of the center of the first through-hole 2*b* with the pin body 21 being inserted into the first through-holes 2*b* and the second through-hole 3*b*

Moreover, a groove portion 21*a* extending along a direction perpendicular to the center of the pin body 21 is formed at a side surface portion of the pin body 21 on the other end side thereof (i.e., a curved surface portion of a circular columnar side surface). The later-described stopper portion 25 is arranged in the groove portion 21*a*.

The bush portion 22 is provided on one end side of the pin body 21, and is arranged on the outside of the pin body 21 in a radial direction thereof in the first through-hole 2*b* with the pin body 21 being inserted into the first through-holes 2*b* and the second through-hole 3*b*. Moreover, the bush portion 22 is formed in a plate shape curved in an arc shape along a side peripheral surface of the pin body 21. That is, the bush portion 22 has an arc-shaped side surface.

The detachment prevention members 23, 24 in the second embodiment include a bolt 23 and a washer 24. The bolt 23 and the washer 24 are screwed to one end of the pin body 21 to prevent detachment of the bush portion 22 from one end side of the pin body 21.

The stopper portion 25 is arranged in the groove portion 21*a* of the pin body 21, and a side surface portion of the stopper portion 25 is formed in an arc shape. That is, the stopper portion 25 is formed in a semilunar plate shape, and is movable relative to the groove portion 21*a*. Moreover, it is configured such that the stopper portion 25 is sandwiched between the groove portion 21*a* of the pin body 21 and an inner wall surface of the tooth 2 forming the first through-hole 2*b* to stop rotation of the pin body 21.

In the case of attaching the tooth 2 to the adaptor 3 of an operating machine, the pin body 21 is inserted into the first through-holes 2*b* and the second through-hole 3*b* with the tooth 2 being attached to the adaptor 3. In this state, the bush portion 22 is arranged in the first through-hole 2*b* on one end side of the pin body 21. On the other hand, the stopper portion 25 placed in the groove portion 21*a* of the pin body 21 is arranged in the first through-hole 2*b* on the other end side of the pin body 21. Moreover, the bolt 23 and the washer 24 are screwed to one end of the pin body 21. In this manner, the attachment pin assembly 10 is attached to the tooth 2 and the adaptor 3, and the bush portion 22 is not detached from one end side of the pin body 21.

Figure 14:
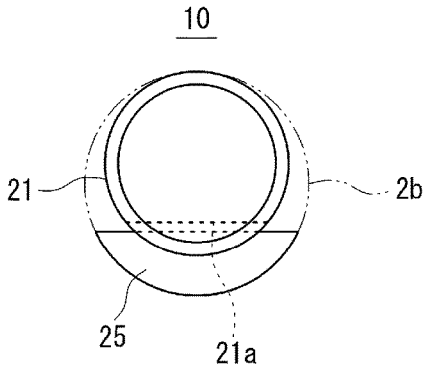
FIG. 14 is a left side view of a positional relationship between the pin body and a stopper portion in the second embodiment.
Figure 15:
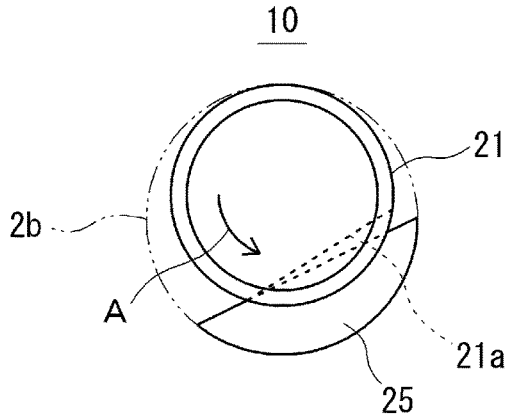
FIG. 15 is a left side view of the positional relationship between the pin body and the stopper portion in the second embodiment.
Figure 16:
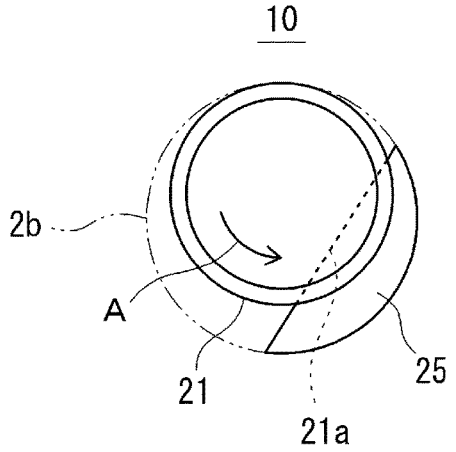
FIG. 16 is a left side view of the positional relationship between the pin body and the stopper portion in the second embodiment.

As illustrated in FIGS. 14 to 16, when the pin body 21 rotates about the center axis of the second through-hole 3*b* (in an arrow A direction in FIGS. 15 and 16) upon screwing, the stopper portion 25 contacts the inner wall surface of the first through-hole 2*b* while moving in the groove portion 21*a* of the pin body 21. When the pin body 21 has rotated a predetermined degrees, the arc-shaped side surface portion of the stopper portion 25 is, in the first through-hole 2*b*, sandwiched between the inner wall surface of the tooth 2 and the groove portion 21*a*.

That is, since the center of the pin body 21 and the center of the first through-hole 2*b* are eccentric with respect to each other, the rotating stopper portion 25 is locked on the inner wall surface of the tooth 2, and as a result, rotation of the pin body 21 can be stopped.

Thus, according to the second embodiment, first through-holes 2*b* of a general-purpose tooth 2 are, as in the above-described first embodiment, utilized so that the process of assembling and detaching the attachment pin assembly 10 can be performed. Moreover, it is not necessary to fix the other end side of the pin body 21 with another jig etc. when the bolt 23 and the washer 24 are screwed to one end of the pin body 21, and therefore, the process of assembling the attachment pin assembly 10 can be facilitated.

Similarly, when the screwed bolt 23 and washer 24 are loosened at one end of the pin body 21, the stopper portion 25 moves in the groove portion 21*a* of the pin body 21, and the arc-shaped side surface portion of the stopper portion 25 is sandwiched between the inner wall surface of the tooth 2 and the groove portion 21*a* in the first through-hole 2*b*. Thus, when the screwed bolt 23 and washer 24 are loosened, rotation of the pin body 21 can be stopped, and therefore, the process of detaching the attachment pin assembly 10 can be facilitated.

Note that in the second embodiment, the example where a clearance is, as illustrated in FIG. 14, formed between the stopper portion 25 and the groove portion 21*a* with the stopper portion 25 contacting the inner wall surface of the tooth 2 in the first through-hole 2*b* has been described. The present invention is not limited to such an example, and no clearance may be formed between the stopper portion 25 and the groove portion 21*a* with the stopper portion 25 contacting the inner wall surface of the tooth 2 in the first through-hole 2*b*.

Other Embodiments

Figure 17:
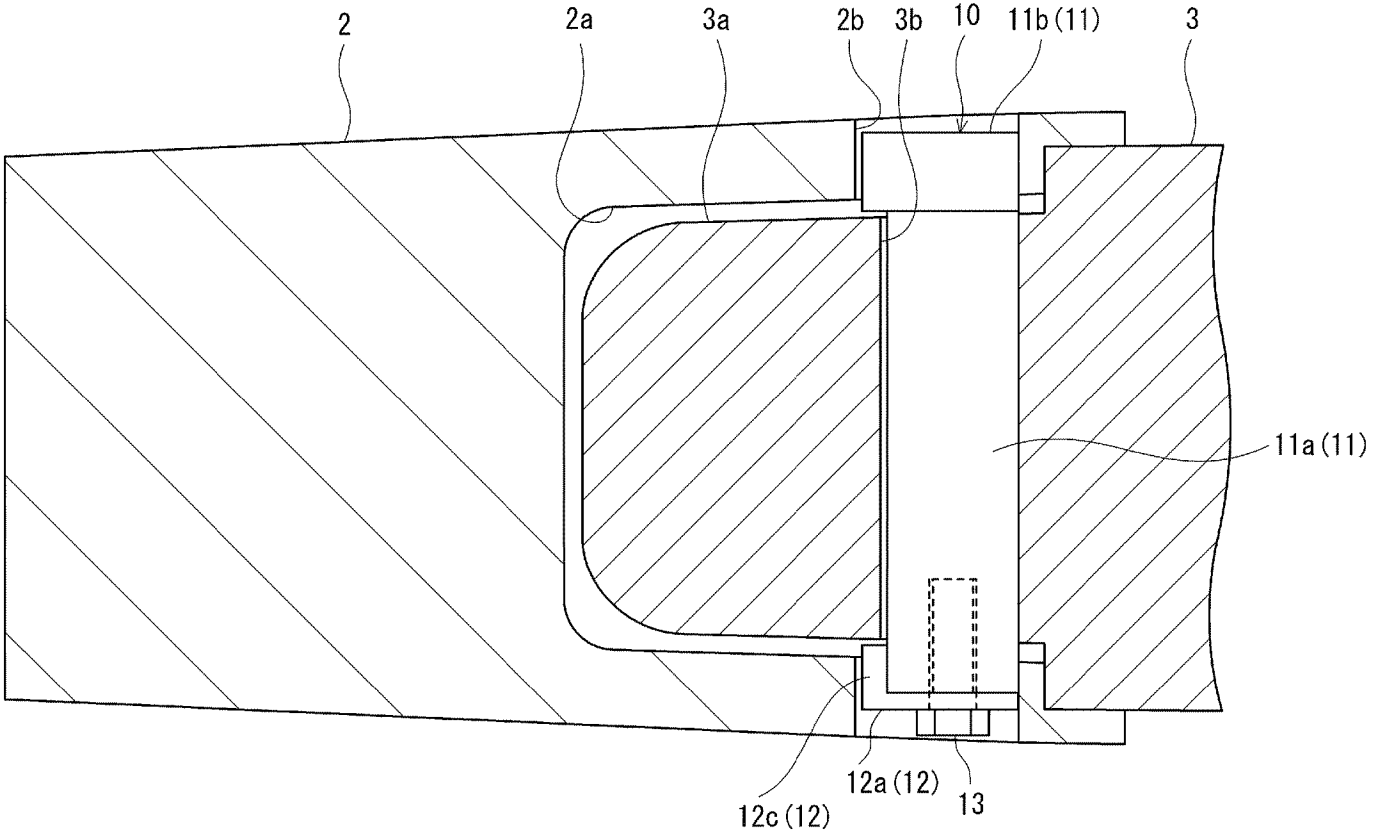
FIG. 17 is a sectional view of a tooth attachment structure of another embodiment.
Figure 18:
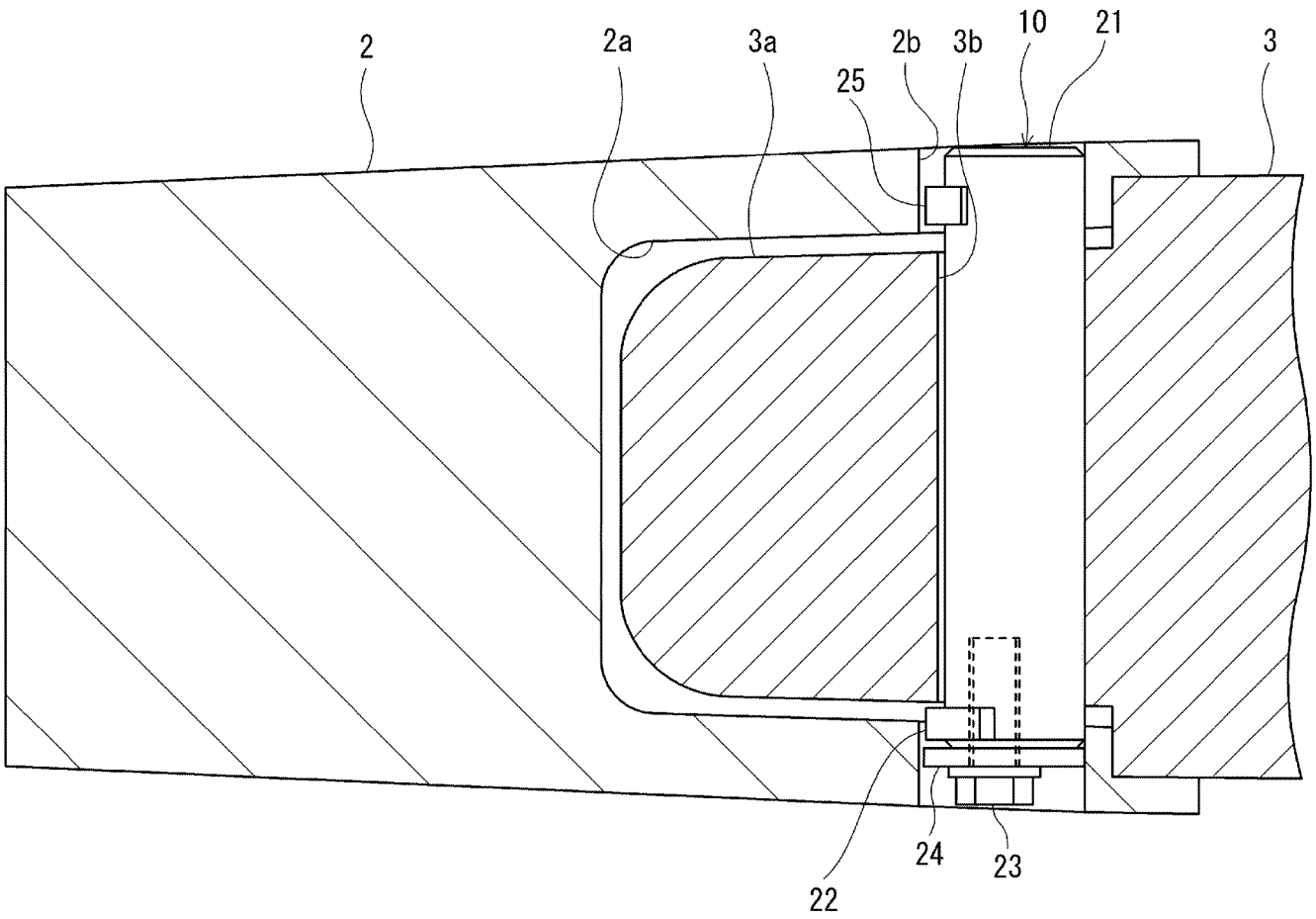
FIG. 18 is a sectional view of a tooth attachment structure of still another embodiment.

FIGS. 17 and 18 are sectional views of other embodiments of the present invention. In the above-described first and second embodiments, the example where the head of the bolt 13, 23 protrudes from the side surface of the tooth 2 has been described above. However, as illustrated in FIGS. 17 and 18, the bolt 13, 23 may be arranged within the first through-hole 2*b* of the tooth 2.

The above-described first and second embodiments have advantages that a relatively-large contact area between the bush portion 12*c*, 22 and the inner wall surface of the tooth 2 in the first through-hole 2*b* can be ensured and that the bush portion 12*c*, 22 can be reliably locked at the tooth 2. With configurations of FIGS. 17 and 18, the bolt 13, 23 is within the first through-hole 2*b*, and therefore, there is an advantage that abrasion resistance of the bolt 13, 23, the washer member 12, and the washer 24 in the drilling process can be improved.

INDUSTRIAL APPLICABILITY

As described above, the present invention is useful for an attachment pin assembly for attaching a drilling tool to an adaptor of an operating machine.

LIST OF REFERENCE NUMERALS

1 bucket
2 tooth (drilling tool)
2*b* first through-hole
3 adaptor
3*b* second through-hole
10 attachment pin assembly
11, 21 pin body
11*b*, 25 stopper portion
12 washer member
12*c*, 22 bush portion
13, 23 bolt
21*a* groove portion
24 washer

The invention claimed is:

1. An attachment pin assembly for attaching and fixing a drilling tool to an adaptor of an operating machine in an attachment state of the drilling tool in which the adaptor is inserted into the drilling tool in contact with the drilling tool, wherein the drilling tool is provided with a pair of first through-holes, and the adaptor is provided with a second through-hole, the second through-hole having a smaller inner diameter than that of each first through-hole, the pair of first through-holes and the second through-hole are arranged to penetrate the drilling tool and the adaptor, and are arranged such that center axes thereof are eccentric with respect to each other, and the attachment pin assembly includes a pin body to be inserted into the first through-holes and the second through-hole, a bush portion provided on one end side of the pin body and arranged on an outside of the pin body in a radial direction thereof in one of the first through-holes, a detachment prevention member screwed to one end of the pin body to prevent detachment of the bush portion from the one end side of the pin body, a stopper portion provided on the other end side of the pin body and configured such that a side surface portion arranged on the outside of the pin body in the radial direction thereof in the one of the first through-holes is locked on an inner wall surface of the drilling tool forming the one of the first through-holes to stop rotation of the pin body, a groove portion extending along a direction perpendicular to a center of the pin body is formed at a side surface portion of the pin body on the other end side thereof, the stopper portion is arranged in the groove portion, and the side surface portion of the stopper portion is formed in an arc shape, and the stopper portion is sandwiched between the groove portion of the pin body and the inner wall surface of the drilling tool forming the one of the first through-holes, thereby stopping rotation of the pin body.

* * * * *